US010381014B2

(12) United States Patent
Jansson Toftgård

(10) Patent No.: US 10,381,014 B2
(45) **Date of Patent: *Aug. 13, 2019**

(54) GENERATION OF COMFORT NOISE

(71) Applicant: Telefonaktiebolaget LM Ericsson (publ), Stockholm (SE)

(72) Inventor: Tomas Jansson Toftgård, Uppsala (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 10 days.

This patent is subject to a terminal disclaimer.

(21) Appl. No.: 15/682,961

(22) Filed: Aug. 22, 2017

(65) Prior Publication Data

US 2017/0352354 A1 Dec. 7, 2017

Related U.S. Application Data

(63) Continuation of application No. 15/175,826, filed on Jun. 7, 2016, now Pat. No. 9,779,741, which is a continuation of application No. 14/427,272, filed as application No. PCT/EP2013/059514 on May 7, 2013, now Pat. No. 9,443,526.

(60) Provisional application No. 61/699,448, filed on Sep. 11, 2012.

(51) Int. Cl.
*G10L 19/012* (2013.01)
*G10L 19/07* (2013.01)

(52) U.S. Cl.
CPC ..... *G10L 19/012* (2013.01); *G10L 19/07* (2013.01)

(58) Field of Classification Search
CPC combination set(s) only.
See application file for complete search history.

(56) References Cited

U.S. PATENT DOCUMENTS 5,630,016 A 5/1997 Swaminathan et al.
5,978,760 A 11/1999 Rao et al.
6,269,331 B1 7/2001 Alanara et al.
(Continued)

FOREIGN PATENT DOCUMENTS

KR 1020090122976 A 12/2009
RU 2461898 C2 9/2012
(Continued)

OTHER PUBLICATIONS

Unknown, Author, "Frame error robust narrow-band and wideband embedded variable bit-rate coding of speech and audio from 8-32 kbit/s", ITU-T, Telecommunication Standardization Sector of ITU, Series G: Transmission Systems and Media, Digital Systems and Networks, Digital Terminal Equipments—Coding of voice and audio signals, G.718, Geneva, CH, Jun. 1, 2008, 1-257.

*Primary Examiner* — Abul K Azad
(74) *Attorney, Agent, or Firm* — Murphy, Bilak & Homiller, PLLC

(57) ABSTRACT

A comfort noise controller for generating CN (Comfort Noise) control parameters is described. A buffer of a predetermined size is configured to store CN parameters for SID (Silence Insertion Descriptor) frames and active hangover frames. A subset selector is configured to determine a CN parameter subset relevant for SID frames based on the age of the stored CN parameters and on residual energies. A comfort noise control parameter extractor (50B) is configured to use the determined CN parameter subset to determine the CN control parameters for a first SID frame following an active signal frame.

16 Claims, 9 Drawing Sheets

(56) References Cited

U.S. PATENT DOCUMENTS

| | | | | |
|---|---|---|---|---|
| 6,606,593 | B1 | 8/2003 | Jarvinen et al. | |
| 9,443,526 | B2 * | 9/2016 | Jansson Toftgard | G10L 19/07 |
| 9,779,741 | B2 * | 10/2017 | Jansson Toftgard | G10L 19/07 |
| 2010/0106490 | A1 * | 4/2010 | Svedberg | G10L 19/012 704/215 |
| 2010/0280823 | A1 * | 11/2010 | Shlomot | G10L 19/012 704/201 |
| 2012/0209599 | A1 | 8/2012 | Malenovsky | |

FOREIGN PATENT DOCUMENTS

| | | | |
|---|---|---|---|
| WO | 0034944 | A1 | 6/2000 |
| WO | 2012110473 | A1 | 8/2012 |

* cited by examiner

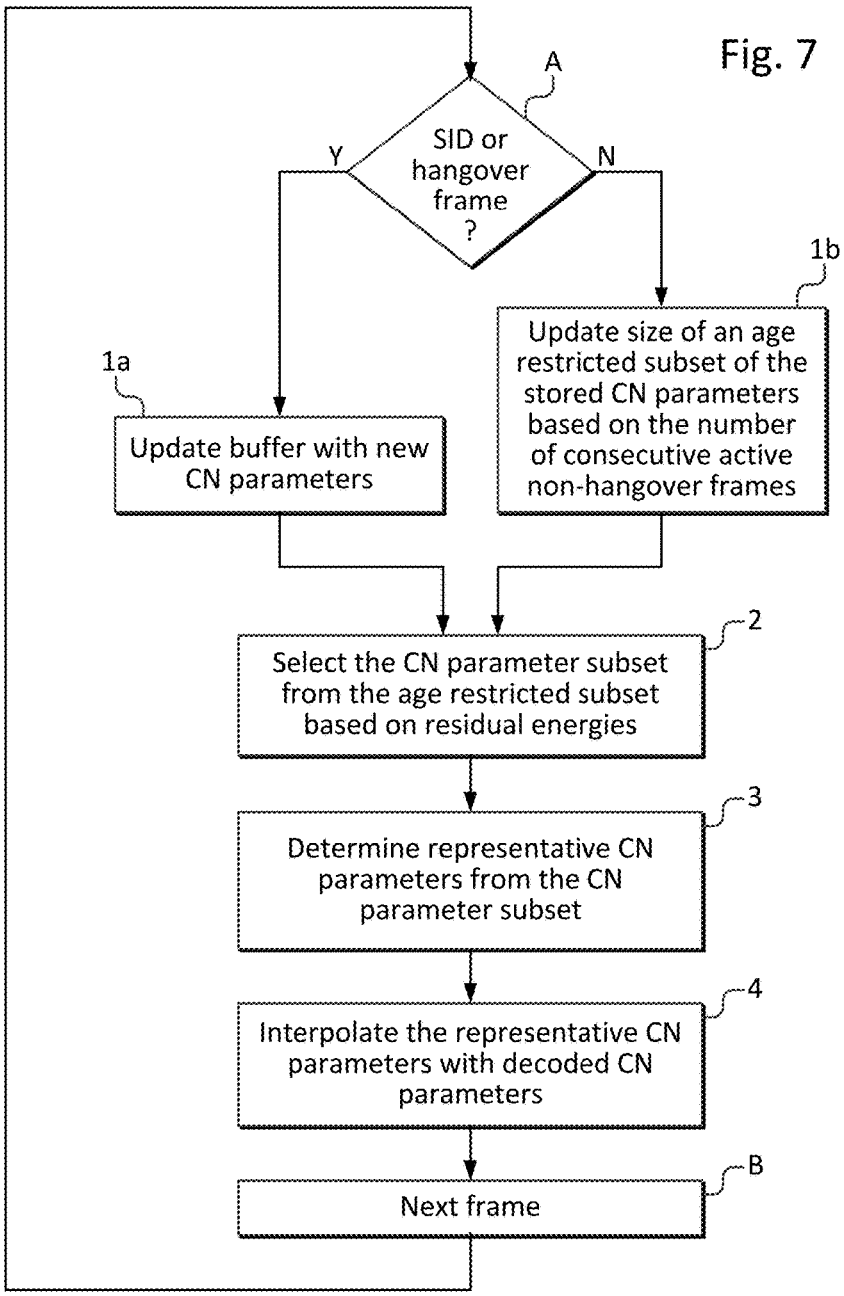
Fig. 7
A
SID or hangover frame ?
Y
N
1b
Update size of an age restricted subset of the stored CN parameters based on the number of consecutive active non-hangover frames
1a
Update buffer with new CN parameters
2
Select the CN parameter subset from the age restricted subset based on residual energies
3
Determine representative CN parameters from the CN parameter subset
4
Interpolate the representative CN parameters with decoded CN parameters
B
Next frame

GENERATION OF COMFORT NOISE

RELATED APPLICATIONS

This application is a continuation of a U.S. patent application Ser. No. 15/175,826, filed 7 Jun. 2016, which is a continuation of U.S. patent application Ser. No. 14/427,272, filed 10 Mar. 2015, which is a national stage entry under 35 U.S.C. § 371 of international patent application serial no. PCT/EP2013/059514, filed 7 May 2013, which claims priority to and the benefit of U.S. provisional patent application Ser. No. 61/699,448, filed 11 Sep. 2012. The entire contents of each of the aforementioned applications are incorporated herein by reference.

TECHNICAL FIELD

The proposed technology generally relates to generation of comfort noise (CN), and particularly to generation of comfort noise control parameters.

BACKGROUND

In coding systems used for conversational speech it is common to use discontinuous transmission (DTX) to increase the efficiency of the encoding. This is motivated by large amounts of pauses embedded in the conversational speech, e.g. while one person is talking the other one is listening. By using DTX the speech encoder can be active only about 50 percent of the time on average. Examples of codecs that have this feature are the 3GPP Adaptive Multi-Rate Narrowband (AMR NB) codec and the ITU-T G.718 codec.

In DTX operation active frames are coded in the normal codec modes, while inactive signal periods between active regions are represented with comfort noise. Signal describing parameters are extracted and encoded in the encoder and transmitted to the decoder in silence insertion description (SID) frames. The SID frames are transmitted at a reduced frame rate and a lower bit rate than used for the active speech coding mode(s). Between the SID frames no information about the signal characteristics is transmitted. Due to the low SID rate the comfort noise can only represent relatively stationary properties compared to the active signal frame coding. In the decoder the received parameters are decoded and used to characterize the comfort noise.

For high quality DTX operation, i.e. without degraded speech quality, it is important to detect the periods of speech in the input signal. This is done by using a voice activity detector (VAD) or a sound activity detector (SAD). FIG. 1 shows a block diagram of a generalized VAD, which analyses the input signal in data frames (of 5-30 ms depending on the implementation), and produces an activity decision for each frame.

A preliminary activity decision (Primary VAD Decision) is made in a primary voice detector 12 by comparison of features for the current frame estimated by a feature extractor 10 and background features estimated from previous input frames by a background estimation block 14. A difference larger than a specified threshold causes the active primary decision. In a hangover addition block 16 the primary decision is extended on the basis of past primary decisions to form the final activity decision (Final VAD Decision). The main reason for using hangover is to reduce the risk of mid and backend clipping in speech segments.

For speech codecs based on linear prediction (LP), e.g. G.718, it is reasonable to model the envelope and frame energy using a similar representation as for the active frames. This is beneficial since the memory requirements and complexity for the codec can be reduced by common functionality between the different modes in DTX operation.

For such codecs the comfort noise can be represented by its LP coefficients (also known as auto regressive (AR) coefficients) and the energy of the LP residual, i.e. the signal that as input to the LP model gives the reference audio segment. In the decoder, a residual signal is generated in the excitation generator as random noise which gets shaped by the CN parameters to form the comfort noise.

The LP coefficients are typically obtained by computing the autocorrelations r[k] of the windowed audio segments x[n], n=0, . . . , N−1 in accordance with:

$$r[k] = \sum_{n=k}^{N-1} x[n]x[n-k],\ k = 0, \ldots, P \tag{1}$$

where P is the pre-defined model order. Then the LP coefficients $a_k$ are obtained from the autocorrelation sequence using e.g. the Levinson-Durbin algorithm.

In a communication system where such a codec is utilized, the LP coefficients should be efficiently transmitted from the encoder to the decoder. For this reason more compact representations that may be less sensitive to quantization noise are commonly used. For example, the LP coefficients can be transformed into linear spectral pairs (LSP). In alternative implementations the LP coefficients may instead be converted to the immitance spectrum pairs (ISP), line spectrum frequencies (LSF) or immitance spectrum frequencies (ISF) domains.

The LP residual is obtained by filtering the reference signal through an inverse LP synthesis filter A[z] defined by:

$$A[z] = 1 + \sum_{k=1}^{P} a_k z^{-k} \tag{2}$$

The filtered residual signal s[n] is consequently given by:

$$s[n] = x[n] + \sum_{k=1}^{P} a_k x[n-k],\ n = 0, \ldots, N-1 \tag{3}$$

for which the energy is defined as:

$$E = \frac{1}{N}\sum_{n=0}^{N-1} s[n]^2 \tag{4}$$

Due to the low transmission rate of SID frames, the CN parameters should evolve slowly in order to not change the noise characteristics rapidly. For example, the G.718 codec limits the energy change between SID frames and interpolates the LSP coefficients to handle this.

To find representative CN parameters at the SID frames, LSP coefficients and residual energy are computed for every frame, including no data frames (thus, for no data frames the mentioned parameters are determined but not transmitted). At the SID frame the median LSP coefficients and mean residual energy are computed, encoded and transmitted to the decoder. In order for the comfort noise to not be unnaturally static, random variations may be added to the comfort noise parameters, e.g. a variation of the residual energy. This technique is for example used in the G.718 codec.

In addition, the comfort noise characteristics are not always well matched to the reference background noise, and slight attenuation of the comfort noise may reduce the listener's attention to this. The perceived audio quality can consequently become higher. In addition, the coded noise in active signal frames might have lower energy than the uncoded reference noise. Therefore attenuation may also be desirable for better energy matching of the noise representation in active and inactive frames. The attenuation is typically in the range 0-5 dB, and can be fixed or dependent on the active coding mode(s) bitrates.

In high efficient DTX systems a more aggressive VAD might be used and high energy parts of the signal (relative to the background noise level) can accordingly be represented by comfort noise. In that case, limiting the energy change between the SID frames would cause perceptual degradation. To better handle the high energy segments, the system may allow larger instant changes of CN parameters for these circumstances.

Low-pass filtering or interpolation of the CN parameters is performed at the inactive frames in order to get natural smooth comfort noise dynamics. For the first SID frame following one or several active frames (from now on just denoted the "first SID"), the best basis for LSP interpolation and energy smoothing would be the CN parameters from previous inactive frames, i.e. prior to the active signal segment.

For each inactive frame, SID or no data, the LSP vector $q_i$ can be interpolated from previous LSP coefficients according to:

$$q_i=\alpha\tilde{q}_{SID}+(1-\alpha)q_{i-1} \tag{5}$$

where i is the frame number of inactive frames, $\alpha\in[0,1]$ is the smoothing factor and $\tilde{q}_{SID}$ are the median LSP coefficients computed with parameters from current SID and all no data frames since the previous SID frame. For the G.718 codec a smoothing factor $\alpha=0.1$ is used.

The residual energy $E_i$ is similarly interpolated at the SID or no data frames according to:

$$E_i=\beta\bar{E}_{SID}+(1-\beta)E_{i-1} \tag{6}$$

where $\beta\in[0,1]$ is the smoothing factor and $\bar{E}_{SID}$ is the averaged energy for current SID and no data frames since the previous SID frame. For the G.718 codec a smoothing factor $\beta=0.3$ is used.

An issue with the described interpolation is that for the first SID the interpolation memories ($E_{i-1}$ and $q_{i-1}$) may relate to previous high energy frames, e.g. unvoiced speech frames, which are classified as inactive by the VAD. In that case the first SID interpolation would start from noise characteristics that are not representative for the coded noise in the close active mode hangover frames. The same issue occurs if the characteristics of the background noise are changed during active signal segments, e.g. segments of a speech signal.

An example of the problems related to prior art technologies is shown in FIG. 2. The spectrogram of a noisy speech signal encoded in DTX operation shows two segments of comfort noise before and after a segment of active coded audio (such as speech). It can be seen that when the noise characteristics from the first CN segment are used for the interpolation in the first SID, there is an abrupt change of the noise characteristics. After some time the comfort noise matches the end of the active coded audio better, but the bad transition causes a clear degradation of the perceived audio quality.

Using higher smoothing factors $\alpha$ and $\beta$ would focus the CN parameters to the characteristics of the current SID, but this could still cause problems. Since the parameters in the first SID cannot be averaged during a period of noise, as following SID frames can, the CN parameters are only based on the signal properties in the current frame. Those parameters might represent the background noise at the current frame better than the long term characteristic in the interpolation memories. It is however possible that these SID parameters are outliers, and do not represent the long term noise characteristics. That would for example result in rapid unnatural changes of the noise characteristics, and a lower perceived audio quality.

SUMMARY

An object of the proposed technology is to overcome at least one of the above stated problems.

A first aspect of the proposed technology involves a method of generating CN control parameters. The method includes the following steps:

- Storing CN parameters for SID frames and active hangover frames in a buffer of a predetermined size.
- Determining a CN parameter subset relevant for SID frames based on the age of the stored CN parameters and on residual energies.
- Using the determined CN parameter subset to determine the CN control parameters for a first SID frame following an active signal frame.

A second aspect of the proposed technology involves a computer program for generating CN control parameters. The computer program comprises computer readable code units which when run on a computer causes the computer to:

- Store CN parameters for SID frames and active hangover frames in a buffer of a predetermined size.
- Determine a CN parameter subset relevant for SID frames based on the age of the stored CN parameters and on residual energies.
- Use the determined CN parameter subset to determine the CN control parameters for a first SID frame ("First SID") following an active signal frame.

A third aspect of the proposed technology involves a computer program product, comprising computer readable medium and a computer program according to the second aspect stored on the computer readable medium.

A fourth aspect of the proposed technology involves a comfort noise controller for generating CN control parameters. The apparatus includes:

- A buffer of a predetermined size configured to store CN parameters for SID frames and active hangover frames.
- A subset selector configured to determine a CN parameter subset relevant for SID frames based on the age of the stored CN parameters and on residual energies.
- A comfort noise control parameter extractor configured to use the determined CN parameter subset to determine the CN control parameters for a first SID frame following an active signal frame.

A fifth aspect of the proposed technology involves a decoder including a comfort noise controller in accordance with the fourth aspect.

A sixth aspect of the proposed technology involves a network node including a decoder in accordance with the fifth aspect.

A seventh aspect of the proposed technology involves a network node including a comfort noise controller in accordance with the fourth aspect.

An advantage of the proposed technology is that it improves the audio quality for switching between active and inactive coding modes for codecs operating in DTX mode. The envelope and signal energy of the comfort noise are matched to previous signal characteristics of similar energies in previous SID and VAD hangover frames.

BRIEF DESCRIPTION OF THE DRAWINGS

The proposed technology, together with further objects and advantages thereof, may best be understood by making reference to the following description taken together with the accompanying drawings, in which:

FIG. 7 is a flow chart illustrating another example embodiment of the method in accordance with the proposed technology;

DETAILED DESCRIPTION

The embodiments described below relate to a system of audio encoder and decoder mainly intended for speech communication applications using DTX with comfort noise for inactive signal representation. The system that is considered utilizes LP for coding of both active and inactive signal frames, where a VAD is used for activity decisions.

Figure 1:
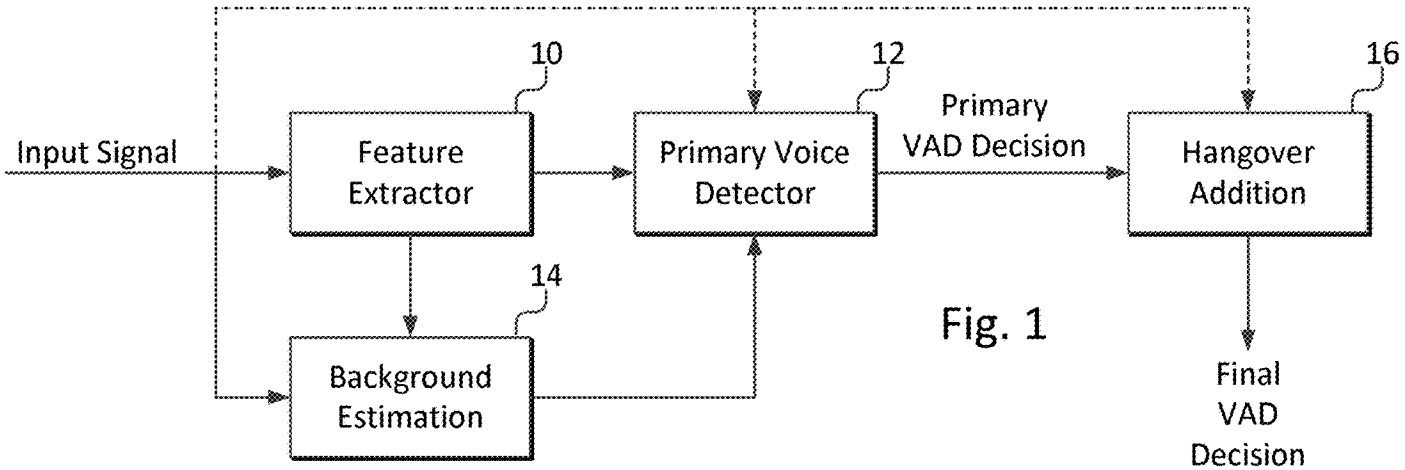
FIG. 1 is a block diagram of a generic VAD.
Figure 3:
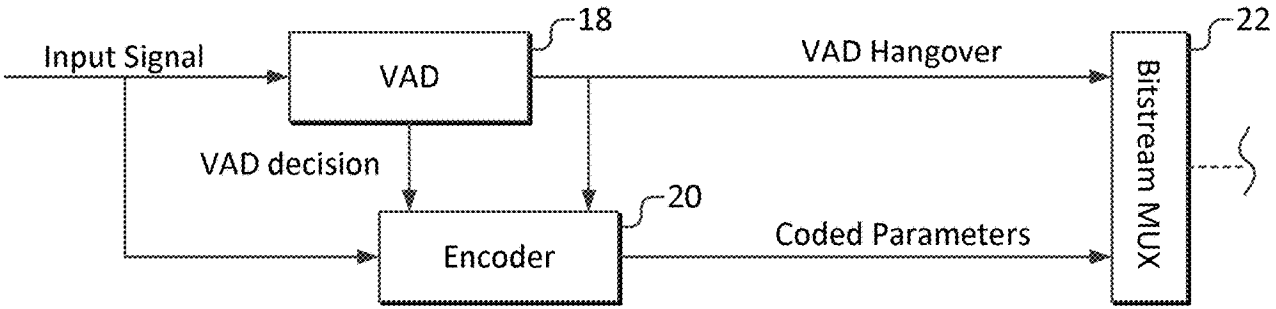
FIG. 3 is a block diagram of an encoder system in a codec.

In the encoder illustrated in FIG. 3 a VAD 18 outputs an activity decision which is used for the encoding by an encoder 20. In addition, the VAD hangover decision is put into the bitstream by a bitstream multiplexer (MUX) 22 and transmitted to the decoder together with the coded parameters of active frames (hangover and non-hangover frames) and SID frames.

Figure 4:
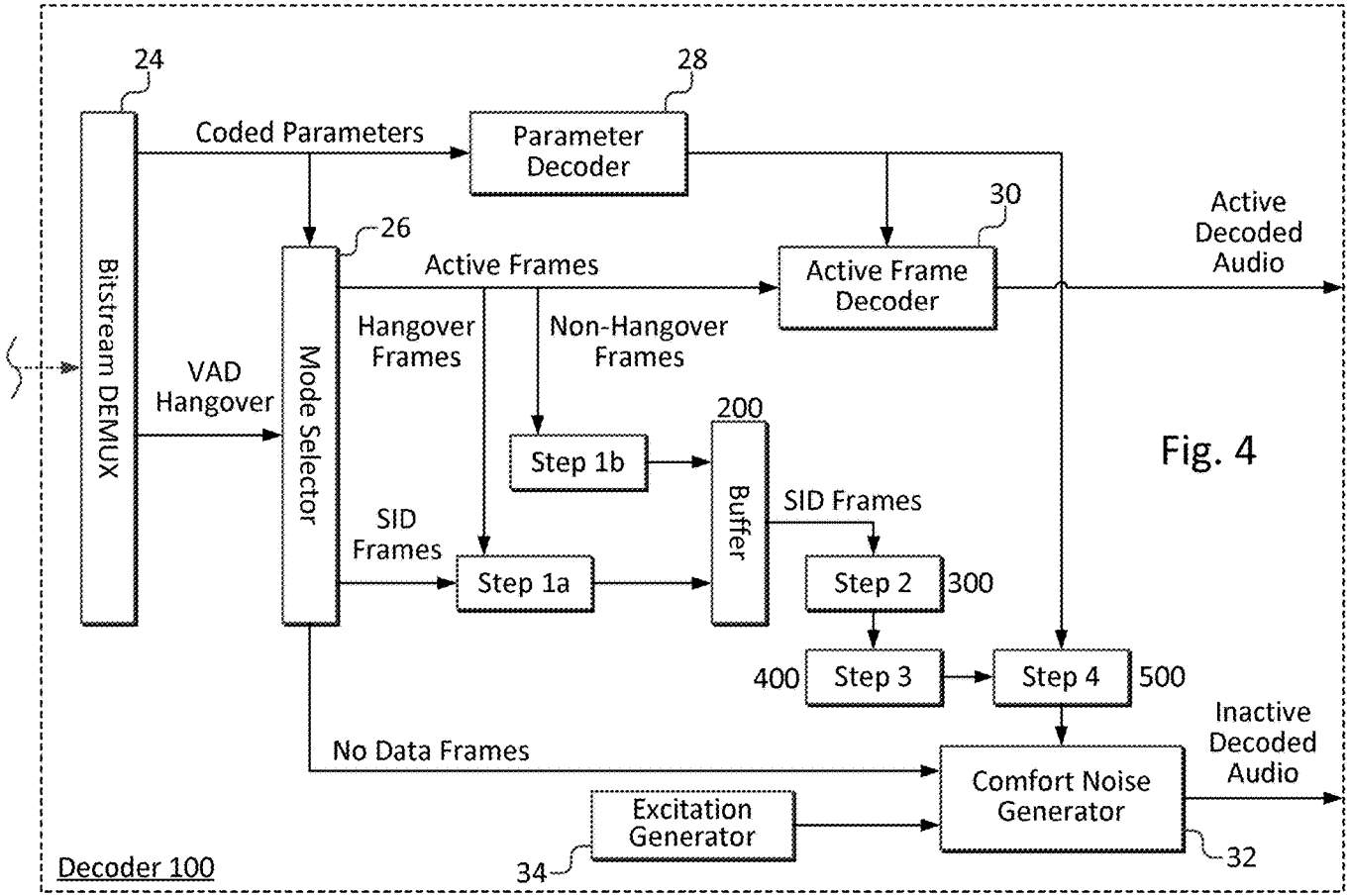
FIG. 4 is a block diagram of an example embodiment of a decoder implementing the method of generating comfort noise according the proposed technology.

The disclosed embodiments are part of an audio decoder. Such a decoder 100 is schematically illustrated in FIG. 4. A bitstream demultiplexer (DEMUX) 24 demultiplexes the received bitstream into coded parameters and VAD hangover decisions. The demultiplexed signals are forwarded to a mode selector 26. Received coded parameters are decoded in a parameter decoder 28. The decoded parameters are used by an active frame decoder 30 to decode active frames from the mode selector 26.

The decoder 100 also includes a buffer 200 of a predetermined size M and configured to receive and store CN parameters for SID and active mode hangover frames, a unit 300 configured to determine which of the stored CN parameters that are relevant for SID based on the age of stored CN parameters, a unit 400 configured to determine which of the determined CN parameters that are relevant for SID based on residual energy measurements, and a unit 500 configured to use the determined CN parameters that are relevant for SID for the first SID frame following active signal frame(s).

The parameters in the buffers are constrained to be recent in order to be relevant. Thereby the sizes of the buffers used for selection of relevant buffer subsets are reduced during longer periods of active coding. Additionally, the stored parameters are replaced by newer values during SID and actively coded hangover frames.

By using circular buffers, the complexity and memory requirement for the buffer handling can be reduced. In such implementations, the already stored elements do not have to be moved when a new element is added. The position of the last added parameter, or parameter set, is used together with the size of the buffer to place new elements. When new elements are added, old elements might be overwritten.

Since the buffers hold parameters from earlier SID and hangover frames they describe signal characteristics of previous audio frames that probably, but not necessarily, contain background noise. The number of parameters that are considered relevant is defined by the size of the buffer and the time, or corresponding number of frames, elapsed since the information was stored.

The technology disclosed herein can be described in a number of algorithmic steps, e.g. performed at the decoder side illustrated in FIG. 4. These steps are:

1a. Step 1a (Performed by the Unit Denoted Step 1a in FIG. 4)—Buffer Update for SID and Hangover Frames:

For each SID and active hangover frame the quantized LSP coefficient vector $\hat{q}$ and corresponding quantized residual energy $\hat{E}$ are stored (in buffer 200) in buffers $$Q^M = \{q_0^M, \ldots, q_{M-1}^M\} \text{ and} \qquad (7)$$

$$E^M = \{E_0^M, \ldots, E_{M-1}^M\}, \text{ i.e.} \begin{cases} q_j^M = \hat{q} \\ E_j^M = \hat{E} \end{cases}$$

The buffer position index $j \in [0, M-1]$ is increased by one prior to each buffer update and reset if the index exceeds the buffer size M, i.e.

$$j=0 \text{ if } j>M-1 \qquad (8)$$

As will be described below, subsets $Q^K$ and $E^K$ of the $K_0$ latest stored elements in $Q^M$ and $E^M$, respectively, define the sets of stored parameters.

1b. Step 1b (Performed by the Unit Denoted Step 1b in FIG. 4)—Buffer Update for Active Non-hangover Frames During decoding of active frames, the size of subsets $Q^K$ and $E^K$ is decreased by a rate of $\gamma^{-1}$ elements per frame according to:

$$\begin{cases} K = K_0 & \text{if} \quad p_A < \gamma \\ K = K - 1 & \text{for} \quad \eta \cdot \gamma \le p_A < (\eta + 1) \cdot \gamma \end{cases} \tag{9}$$

where $K_0$ is the number of stored elements in previous SID and hangover frames, $\eta \in \mathbb{Z}^+$ and $p_A$ is the number of consecutive active non-hangover frames. The rate of decrement relates to time, where $\gamma=25$ is feasible for 20 ms frames. This corresponds to a decrease by one element every half second while decoding active frames. The decrement rate constant $\gamma$ can potentially be defined as any value $\gamma \in \mathbb{Z}^+$, but it should be chosen such that old noise characteristics that are likely not to represent the current background noise are excluded from the subsets $Q^K$ and $E^K$. The value might for example be chosen based on the expected dynamics of the background noise. In addition, the natural length of speech bursts and the behavior of the VAD may be considered, as long sequences of consecutive active frames are unlikely. Typically, the constant would be in the range $\gamma \le 500$ for 20 ms frames, which corresponds to less than 10 seconds. As an alternative equation (9) may be written in a more compact form as:

$$K = K_0 - \eta \text{ for } \eta \cdot \gamma \le p_A < (\eta + 1) \cdot \gamma \tag{10}$$

where $K_0$ is the number of CN parameters for SID frames and active hangover frames stored in the buffer 200, $\gamma$ is a predetermined constant, and $\eta$ is a non-negative integer.

2. Step 2 (Performed by the Unit Denoted Step 2 in FIG. 4)—Selection of Relevant Buffer Elements At the first SID following active frames a subset of the buffer $E^K$ is selected based on the residual energies. The subset $E^S=\{E_0^S, \ldots, E_{L-1}^S\} \subseteq E^K$ of size L is defined as:

$$E^S = \{E_k^K \in E^K | E_{k_0}^K - \gamma_1 < E_k^K < E_{k_0}^K + \gamma_2\} \text{ for } k = k_0, \ldots, k_{K-1} \tag{11}$$

where $E_{k_0}^K$ is the latest stored residual energy, $\gamma_1$ and $\gamma_2$ are predetermined lower and upper bounds, respectively, for residual energies considered to be representative of noise at a transition from active to inactive frames (for example $\gamma_1=200$ and $\gamma_2=20$), $k_0, \ldots, k_{K-1}$ are sorted such that $k_0$ corresponds to the latest and $k_{K-1}$ to the oldest stored CN parameter.

Typically, $\gamma_2$ is selected from the range $\gamma_2 \in [0,100]$ as larger values would include high residual energies compared to the latest stored residual energy $E_{k_0}^K$. This could cause a significant step-up of the comfort noise energy that would cause an audible degradation. It is also desirable to exclude signal characteristics from speech frames, which generally have larger energy, as these characteristics are generally not representing the background noise well. $\gamma_1$ can be selected slightly larger than $\gamma_2$, e.g. from the range $\gamma_1 \in [50,500]$, as a step-down in energy is usually less annoying. Additionally, the likelihood of including speech signal characteristics is generally less for frames with a residual energy less than $E_{k_0}^K$ than it is for frames with a residual energy larger than $E_{k_0}^K$.

It should be noted that the energies $E_k^K$ can as well as in linear domain be represented in a logarithmic domain, e.g. dB. With energies in logarithmic domain the selection of relevant buffer elements, as specified in equation (11), is described equivalently with energies $E_k^K$ in linear domain as:

$$E^S = \{E_k^K \in E^k | E_{k_0}^K \tilde{\gamma}_1 < E_k^K < E_{k_0}^K \tilde{\gamma}_2\} \text{ for } k = k_0, \ldots, k_{K-1} \tag{12}$$

where $\log(\tilde{\gamma}_1)=-\gamma_1$ and $\log(\tilde{\gamma}_2)=\gamma_2$. Suitable boundaries specifying the subset of the buffer $E^K$ are for example given by $\tilde{\gamma}_1=0.7$ and $\tilde{\gamma}_2=1.03$ or $\hat{\gamma}_1 \in [0.5,0.9]$ and $\tilde{\gamma}_2 \in [1.0,1.25]$. The corresponding vectors in the LSP buffer $Q^K$ define the subset $Q^S=\{q_0^S, \ldots, q_{L-1}^S\}$.

3. Step 3 (Performed by the Unit Denoted Step 3 in FIG. 4)—Determination of Representative Comfort Noise Parameters To find a representative residual energy the weighted mean of the subset $E^S$ is computed as:

$$\overline{E} = \frac{\sum_{k=0}^{L-1} w_k^S E_k^S}{\sum_{k=0}^{L-1} w_k^S} \tag{13}$$

where $w_k^S$ are the elements in the subset of weights:

$$w^S = \{w_j^M \in w^M\} \text{ for } \forall j | E_j^M \in E^S$$

For a maximum buffer size M=8 a suitable set of weights is:

$$w^M = \{0.2, 0.16, 0.128, 0.1024, 0.08192, 0.065536, 0.0524288, 0.01048576\}$$

This means that recent energies get more weight in the residual energy mean $\overline{E}$, which makes the energy transition between active and inactive frames smoother.

Among LSP vectors in the subset $Q^S$, the median LSP vector is selected by computing the distances between all the LSP vectors in the subset buffer $E^S$ according to:

$$R_{lm} = \sum_{p=1}^{P} (q_l^S[p] - q_m^S[p])^2 \text{ for } l, m = 0, \ldots, L-1 \tag{14}$$

where $q_l^S[p]$ are the elements in the vector $q_l^S$.

For every LSP vector the distance to the other vectors are summed, i.e.

$$S_l = \sum_{m=0}^{L-1} R_{lm} \text{ for } l = 0, \ldots, L-1 \tag{15}$$

The median LSP vector is given by the vector with the smallest distance to the other vectors in the subset buffer, i.e.

$$\tilde{q} = \{q_l \in Q^S | S_l \le S_m, l \ne m\} \text{ for } l, m = 0, \ldots, L-1 \tag{16}$$

If several vectors have equal total distance, the median can be arbitrarily chosen among those vectors.

As an alternative representative LSP vector may be determined as the mean vector of the subset $Q^S$.

4. Step 4 (Performed by the Unit Denoted Step 4 in FIG. 4)—Interpolation of Comfort Noise Parameters for First SID Frame The LSP median or mean vector $\tilde{q}$ and the averaged residual energy $\overline{E}$ are used in the interpolation of CN parameters in the first SID frame as described in equations (5) and (6) with:

$$\begin{cases} q_{i-1} = \tilde{q} \\ E_{i-1} = \overline{E} \end{cases} \tag{17}$$

The values of $\tilde{q}_{SID}$ and $\overline{E}_{SID}$ are obtained from the parameter decoder 28. The smoothing factors $\alpha \in [0,1]$ and $\beta \in [0,1]$ can for the first SID frame be different from the factors used in following SID and no data frames interpolation of CN parameters. Additionally, the factors could for example be dependent on a measure that further describe the reliability of the determined parameters $\tilde{q}$ and $\bar{E}$, e.g. the size of the subsets $Q^S$ and $E^S$. Suitable values are for example $\alpha=0.2$ and $\beta=0.2$ or $\beta=0.05$. The comfort noise parameters for the first SID frame are then used by a comfort noise generator 32 to control filling of no data frames from mode selector 26 with noise based on excitations from excitation generator 34.

If the subsets $Q^S$ and $E^S$ are empty, the latest extracted SID parameters may be used directly without interpolation from older noise parameters.

The transmitted LSP vector $\tilde{q}_{SID}$ used in the interpolation is in the encoder usually obtained directly from the LP analysis of the current frame, i.e. no previous frames are considered. The transmitted residual energy $\bar{E}_{SID}$ is preferably obtained using LP parameters corresponding to the LSP parameters used for the signal synthesis in the decoder. These LSP parameters can be obtained in the encoder by performing steps 1-4 with a corresponding encoder side buffer. Operating the encoder in this way implies that the energy of the decoder output can be matched to the input signal energy by control of the encoded and transmitted residual energy since the decoder synthesis LP parameters are known in the encoder.

Figure 2:
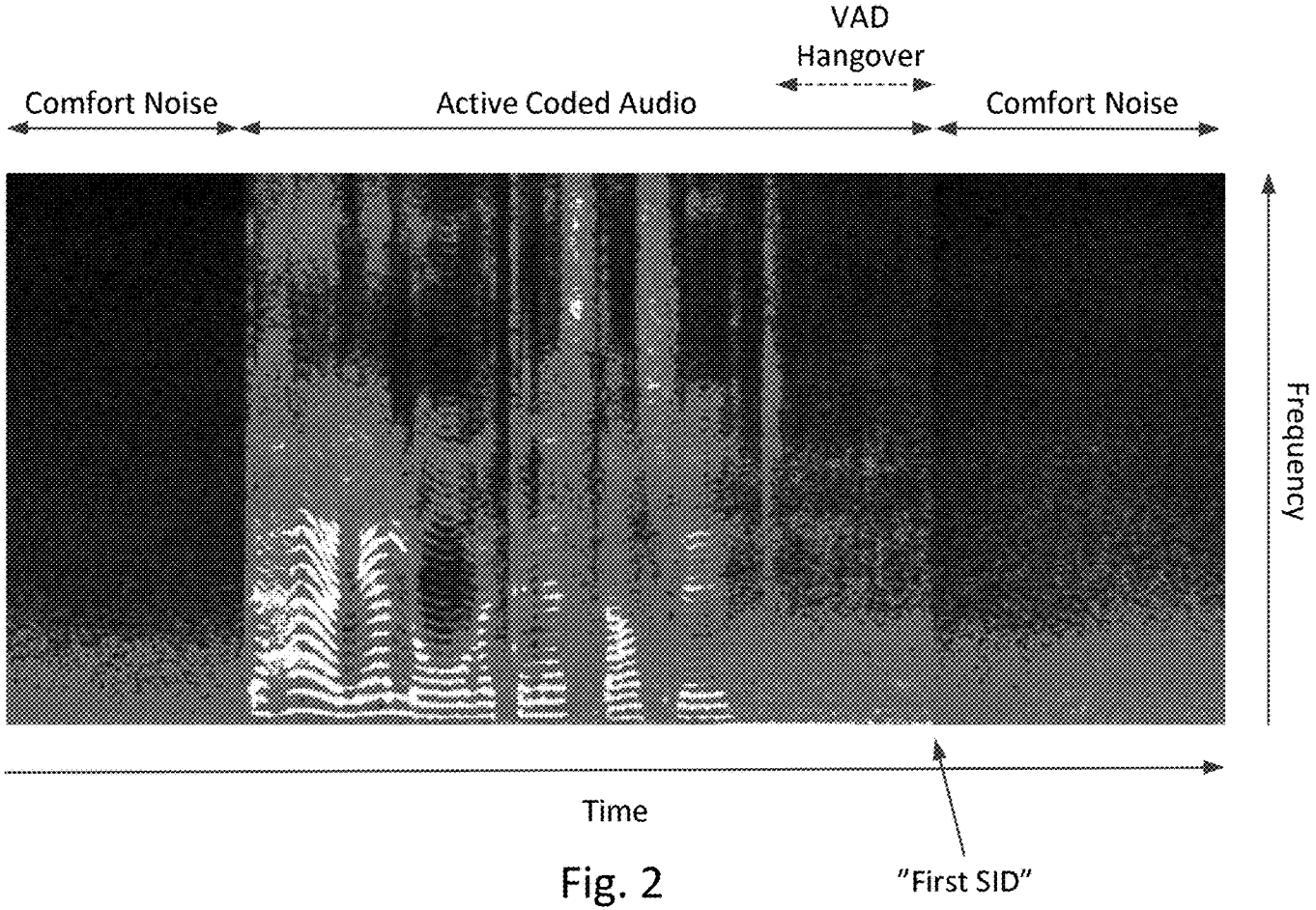
FIG. 2 is an example of a spectrogram of a noisy speech signal that has been decoded in accordance with prior art DTX solutions.
Figure 5:
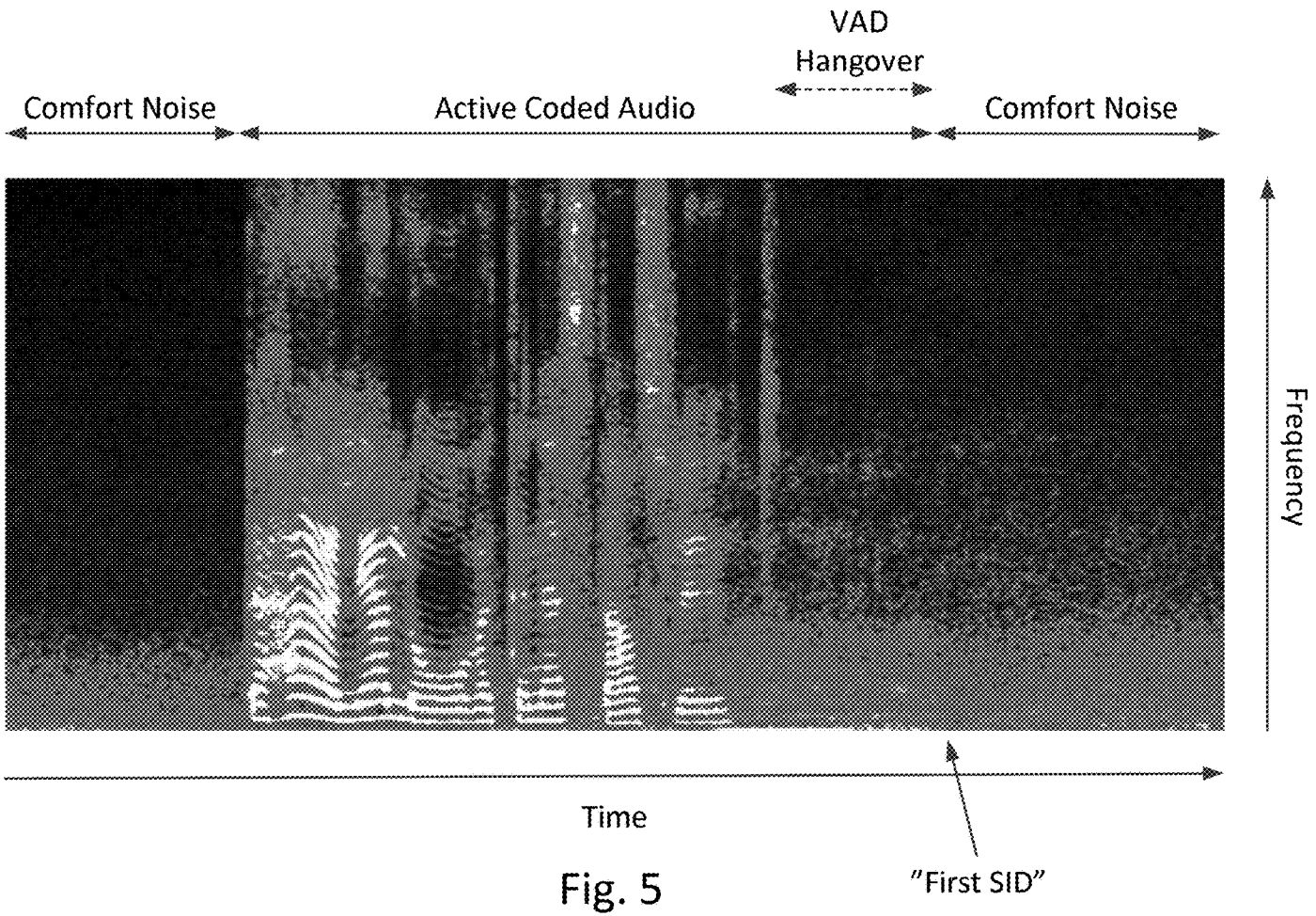
FIG. 5 is an example of a spectrogram of a noisy speech signal that has been decoded in accordance with the proposed technology.

FIG. 5 is an example of a spectrogram of a noisy speech signal that has been decoded in accordance with the proposed technology. The spectrogram corresponds to the spectrogram in FIG. 2, i.e. it is based on the same encoder side input signal. By comparing the spectrograms of the prior art (FIG. 2) and the proposed solution (FIG. 5), it is clearly seen that the transition between the actively coded audio and the second comfort noise region is smoother for the latter. In this example a subset of the signal characteristics at the VAD hangover frames are used to obtain the smooth transition. For other signals with shorter segments of active frames the parameter buffers might also contain parameters from close in time SID frames.

Although it is true that there will be only one first SID frame following an active signal frame, it will indirectly affect the CN parameters in following SID frames due to the smoothing/interpolation.

Figure 6:
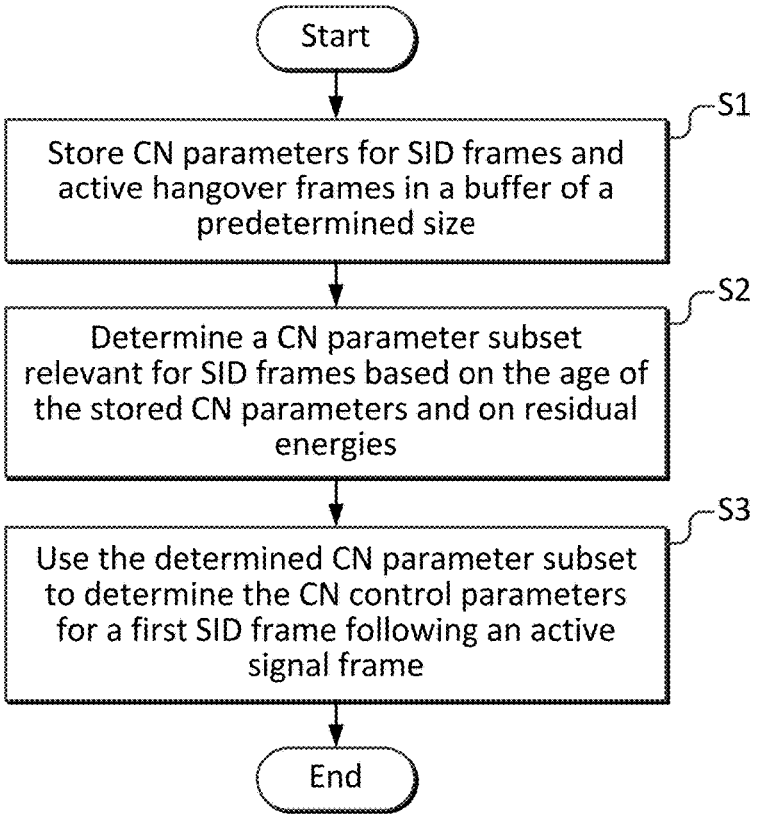
FIG. 6 is a flow chart illustrating an example embodiment of the method in accordance with the proposed technology.

FIG. 6 is a flow chart illustrating an example embodiment of the method in accordance with the proposed technology. Step S1 stores CN parameters for SID frames and active hangover frames in a buffer of a predetermined size. Step S2 determines a CN parameter subset relevant for SID frames based on the age of the stored CN parameters and on residual energies. Step S3 uses the determined CN parameter subset to determine the CN control parameters for a first SID frame following an active signal frame (in other words, it determines the CN control parameters for a first SID frame following an active signal frame based on the determined CN parameter subset).

FIG. 7 is a flow chart illustrating another example embodiment of the method in accordance with the proposed technology. The figure illustrates the method steps performed for each frame. Different parts of the buffer (such as 200 in FIG. 4) are updated depending on whether the frame is an active non-hangover frame or a SID/hangover frame (decided in step A, which corresponds to mode selector 26 in FIG. 4). If the frame is a SID or hangover frame, step 1a (corresponds to the unit that is denoted step 1a in FIG. 4) updates the buffer with new CN parameters, for example as described under subsection 1a above. If the frame is an active non-hangover frame, step 1b (corresponds to the unit that is denoted step 1b in FIG. 4) updates the size of an age restricted subset of the stored CN parameters based on the number of consecutive active non-hangover frames, for example as described under subsection 1b above. Step 2 (corresponds to the unit that is denoted step 2 in FIG. 4) selects the CN parameter subset from the age restricted subset based on residual energies, for example as described under subsection 2 above. Step 3 (corresponds to the unit that is denoted step 3 in FIG. 4) determines representative CN parameters from the CN parameter subset, for example as described under subsection 3 above. Step 4 (corresponds to the unit that is denoted step 4 in FIG. 4) interpolates the representative CN parameters with decoded CN parameters, for example as described under subsection 4 above. Step B replaces the current frame with the next frame, and then the procedure is repeated with that frame.

Figure 8:
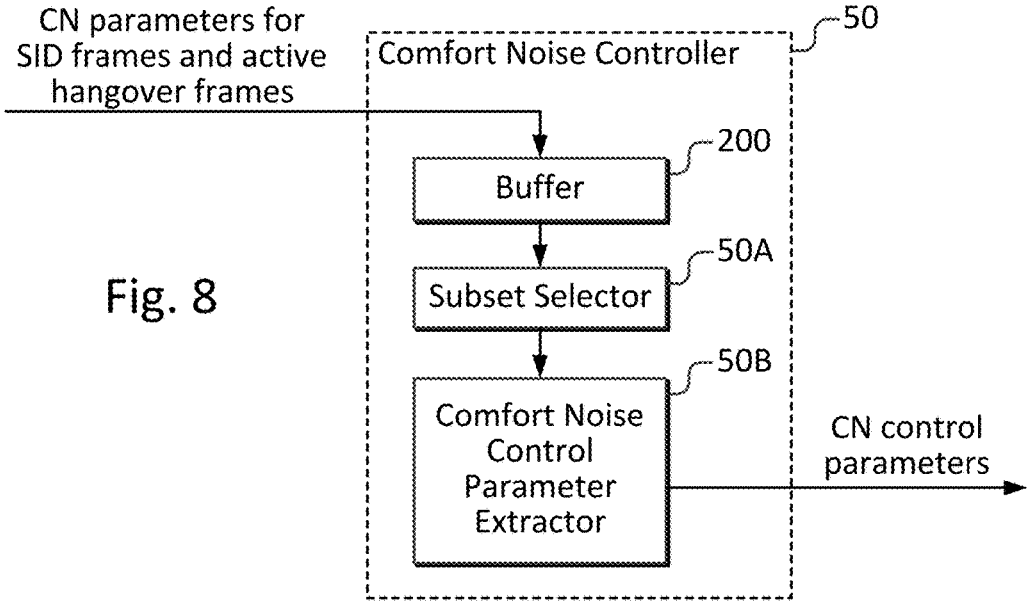
FIG. 8 is a block diagram illustrating an example embodiment of the comfort noise controller in accordance with the proposed technology.

FIG. 8 is a block diagram illustrating an example embodiment of the comfort noise controller 50 in accordance with the proposed technology. A buffer 200 of a predetermined size is configured to store CN parameters for SID frames and active hangover frames. A subset selector 50A is configured to determine a CN parameter subset relevant for SID frames based on the age of the stored CN parameters and on residual energies. A comfort noise control parameter extractor 50B is configured to use the determined CN parameter subset to determine the CN control parameters for a first SID frame ("First SID") following an active signal frame.

Figure 9:
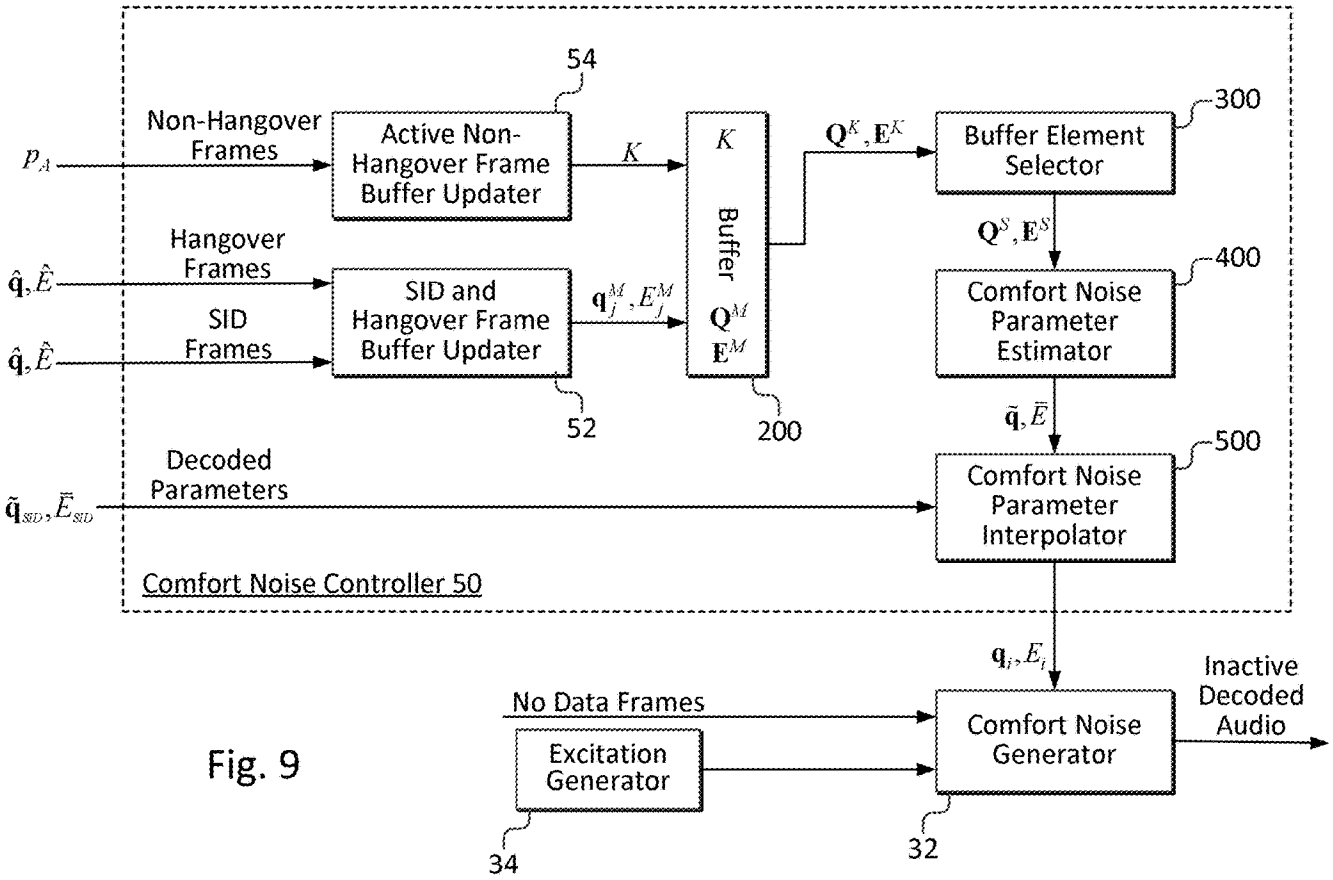
FIG. 9 is a block diagram illustrating another example embodiment of the comfort noise controller in accordance with the proposed technology.

FIG. 9 is a block diagram illustrating another example embodiment of the comfort noise controller 50 in accordance with the proposed technology. A SID and hangover frame buffer updater 52 is configured to update, for SID frames and active hangover frames, the buffer 200 with new CN parameters $\hat{q},\hat{E}$, for example as described under subsection 1a above. A non-hangover frame buffer updater 54 is configured to update, for active non-hangover frames, the size K of an age restricted subset $Q^K,E^K$ of the stored CN parameters based on the number $p_A$ of consecutive active non-hangover frames, for example as described under subsection 1b above. A buffer element selector 300 is configured to select the CN parameter subset $Q^S,E^S$ from the age restricted subset $Q^K,E^K$ based on residual energies, for example as described under subsection 2 above. A comfort noise parameter estimator 400 is configured to determine representative CN parameters $\tilde{q},\bar{E}$ from the CN parameter subset $Q^S,E^S$, for example as described under subsection 3 above. A comfort noise parameter interpolator 500 is configured to interpolate the representative CN parameters $\tilde{q},\bar{E}$ with decoded CN parameters $\tilde{q}_{SID},\bar{E}_{SID}$, for example as described under subsection 4 above. The obtained comfort noise control parameters $q_i,E_i$ for the first SID frame are then used by comfort noise generator 32 to control filling of no data frames with noise based on excitations from excitation generator 34.

The steps, functions, procedures and/or blocks described herein may be implemented in hardware using any conventional technology, such as discrete circuit or integrated circuit technology, including both general-purpose electronic circuitry and application-specific circuitry.

Alternatively, at least some of the steps, functions, procedures and/or blocks described herein may be implemented in software for execution by suitable processing equipment. This equipment may include, for example, one or several microprocessors, one or several Digital Signal Processors (DSP), one or several Application Specific Integrated Circuits (ASIC), video accelerated hardware or one or several suitable programmable logic devices, such as Field Programmable Gate Arrays (FPGA). Combinations of such processing elements are also feasible.

It should also be understood that it may be possible to reuse the general processing capabilities already present in a network node, such as a mobile terminal or pc. This may, for example, be done by reprogramming of the existing software or by adding new software components.

Figure 10:
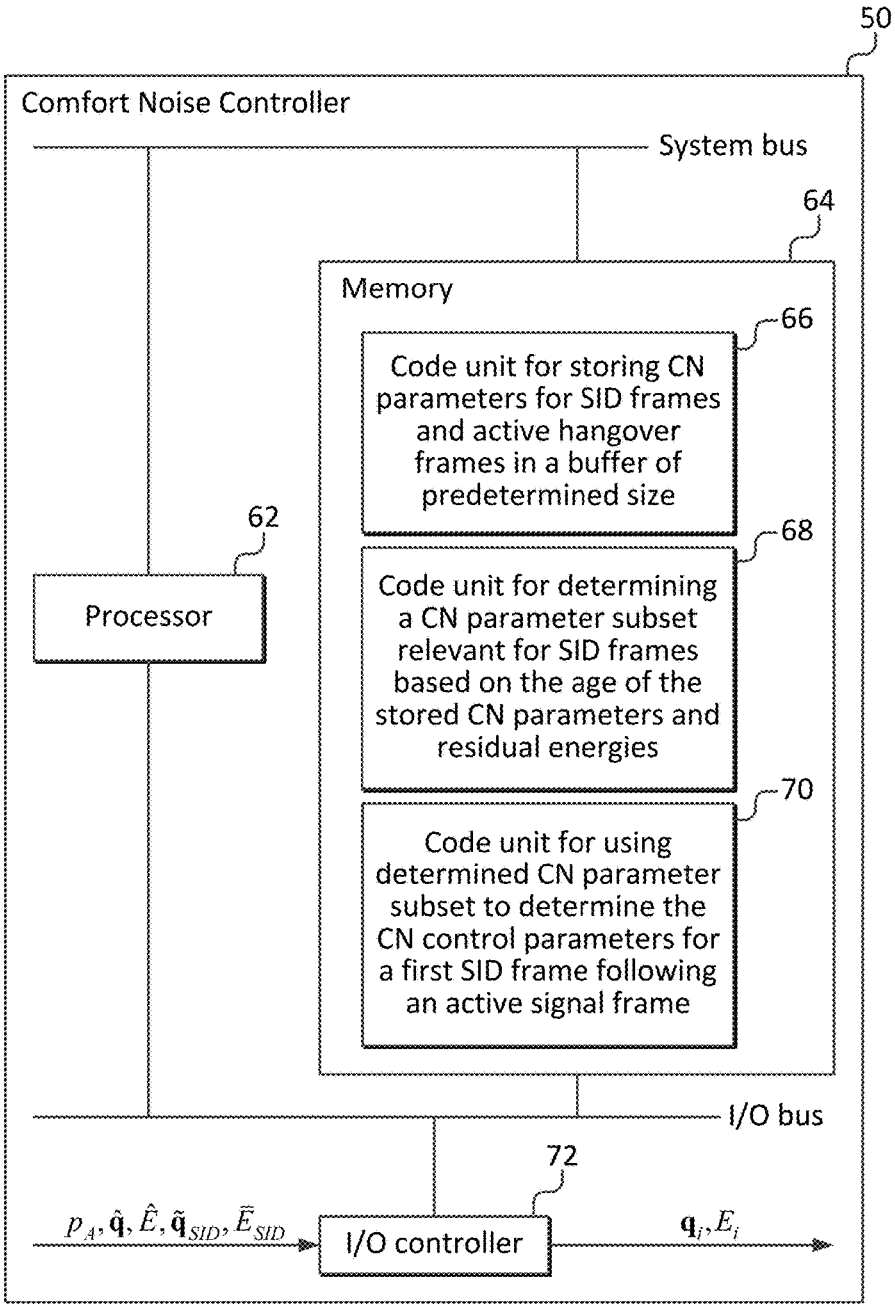
FIG. 10 is a block diagram illustrating another example embodiment of the comfort noise controller in accordance with the proposed technology.

FIG. 10 is a block diagram illustrating another example embodiment of a comfort noise controller 50 in accordance with the proposed technology. This embodiment is based on a processor 62, for example a microprocessor, which executes a computer program for generating CN control parameters. The program is stored in memory 64. The program includes a code unit 66 for storing CN parameters for SID frames and active hangover frames in a buffer of predetermined size, a code unit 68 for determining a CN parameter subset relevant for SID frames based on the age of the stored CN parameters and residual energies, and a code unit 70 for using the determined CN parameter subset to determine the CN control parameters for a first SID frame following an active signal frame. The processor 62 communicates with the memory 64 over a system bus. The inputs $p_A$, $\hat{q}$, $\hat{E}$, $\tilde{q}_{SID}$, $\bar{E}_{SID}$ are received by an input/output (I/O) controller 72 controlling an I/O bus, to which the processor 62 and the memory 64 are connected. The CN control parameters $q_i$,$E_i$ obtained from the program are outputted from the memory 64 by the I/O controller 72 over the I/O bus.

According to an aspect of the embodiments, a decoder for generating comfort noise representing an inactive signal is provided. The decoder can operate in DTX mode and can be implemented in a mobile terminal and by a computer program product which can be implemented in the mobile terminal or pc. The computer program product can be downloaded from a server to the mobile terminal.

Figure 11:
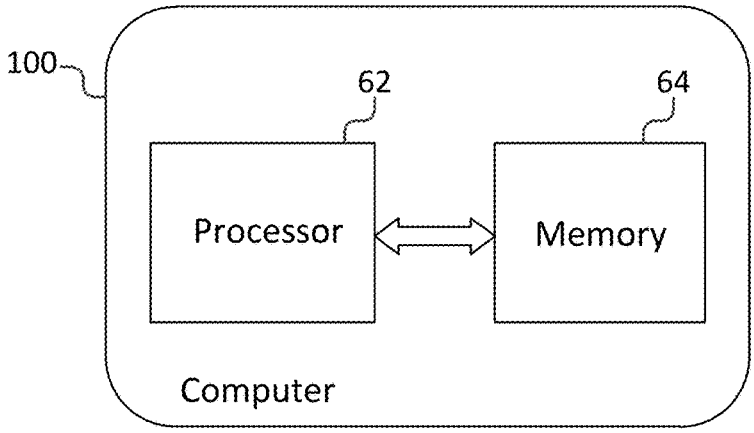
FIG. 11 is a schematic diagram showing some components of an example embodiment of a decoder, wherein the functionality of the decoder is implemented by a computer.

FIG. 11 is a schematic diagram showing some components of an example embodiment of a decoder 100 wherein the functionality of the decoder is implemented by a computer. The computer comprises a processor 62 which is capable of executing software instructions contained in a computer program stored on a computer program product. Furthermore, the computer comprises at least one computer program product in the form of a non-volatile memory 64 or volatile memory, e.g. an EEPROM (Electrically Erasable Programmable Read-only Memory), a flash memory, a disk drive or a RAM (Random-access memory). The computer program, enables storing CN parameters for SID and active mode hangover frames in a buffer of a predetermined size, determining which of the stored CN parameters that are relevant for SID based on age of the stored CN parameters and residual energy measurements, and using the determined CN parameters that are relevant for SID for estimating the CN parameters in the first SID frame following an active signal frame(s).

Figure 12:
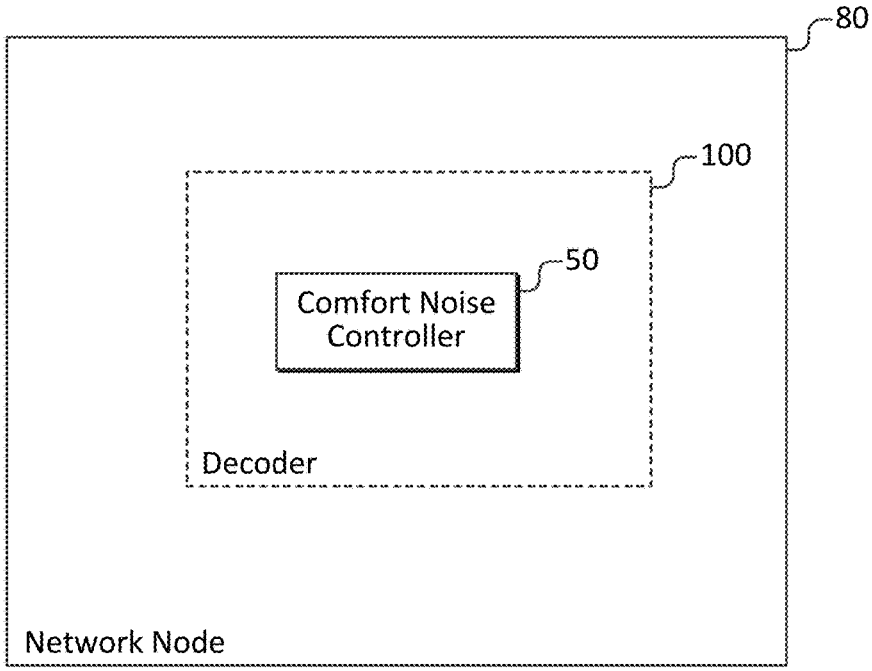
FIG. 12 is a block diagram illustrating a network node that includes a comfort noise controller in accordance with the proposed technology.

FIG. 12 is a block diagram illustrating a network node 80 that includes a comfort noise controller 50 in accordance with the proposed technology. The network node 80 is typically a User Equipment (UE), such as a mobile terminal or PC. The comfort noise controller 50 may be provided in a decoder 100, as indicated by the dashed lines. As an alternative, it may be provided in an encoder, as outlined above.

In the embodiments of the proposed technology described above the LP coefficients $a_k$ are transformed to an LSP domain. However, the same principles may also be applied to LP coefficients that are transformed to an LSF, ISP or ISF domain.

For codecs with attenuation of the comfort noise it can be beneficial to gradually attenuate the actively coded signal during VAD hangover frames. The energy for the comfort noise would then better match the latest actively coded frame, which further improves the perceived audio quality. An attenuation factor λ can be computed and applied to the LP residual for each hangover frame by:

$$s[n] = \lambda \cdot s[n] \tag{18}$$

with $$\lambda = \max\left(0.6, \frac{1}{1 + 0.1 p_{HO}}\right) \tag{19}$$

where $p_{HO}$ is the number of consecutive VAD hangover frames. As an alternative λ may be computed as:

$$\lambda = \max\left(L, \frac{1}{1 + \frac{L}{L_0} p_{HO}}\right) \tag{20}$$

where L=0.6 and $L_0$=6 control the maximum attenuation and rate of attenuation. The maximum attenuation can typically be selected in the range L=[0.5,1) and the rate control parameter $L_0$ for example be selected such that $$L_0 = \frac{L^2}{1 - L} p_{HO}^{FULL},$$

where $p_{HO}^{FULL}$ is the number of frames needed for maximum attenuation. $p_{HO}^{FULL}$ could for example be set to the average or maximum number of consecutive VAD hangover frames that is possible (due to the hangover addition in the VAD). Typically, this would be in the range of $p_{HO}^{FULL}$= {1, . . . ,15} frames.

It should be understood that the technology described herein can co-operate with other solutions handling the first CN frames following active signal segments. For example, it can complement an algorithm where a large change in CN parameters is allowed for high energy frames (relative to background noise level). For these frames, the previous noise characteristics might not much affect the update in the current SID frame. The described technology may then be used for frames that are not detected as high energy frames.

It will be understood by those skilled in the art that various modifications and changes may be made to the proposed technology without departure from the scope thereof, which is defined by the appended claims.

ABBREVIATIONS

ACELP Algebraic Code-Excited Linear Prediction
AMR Adaptive Multi-Rate
AMR NB AMR Narrowband
AR Auto Regressive
ASIC Application Specific Integrated Circuits
CN Comfort Noise
DFT Discrete Fourier Transform
DSP Digital Signal Processors
DTX Discontinuous Transmission
EEPROM Electrically Erasable Programmable Read-only Memory
FPGA Field Programmable Gate Arrays
ISF Immitance Spectrum Frequencies ISP Immitance Spectrum Pairs
LP Linear Prediction
LSF Line Spectral Frequencies
LSP Line Spectral Pairs
MDCT Modified Discrete Cosine Transform
RAM Random-access memory
SAD Sound Activity Detector
SID Silence Insertion Descriptor
UE User Equipment
VAD Voice Activity Detector

What is claimed is:

1. A method of generating Comfort Noise (CN) control parameters, comprising:

storing CN parameter sets in a buffer of a predetermined size (M) for Silence Insertion Descriptor (SID) frames and active hangover frames of an encoded audio signal, where the CN parameter set stored for each SID frame or active hangover frame includes a residual energy value;

determining representative CN parameters for a first SID frame following an active non-hangover frame of the encoded audio signal, based on a relevant subset of the CN parameter sets stored in the buffer, and determining the relevant subset based on an age of the stored CN parameter sets and the residual energy values; and using the representative CN parameters to determine the CN control parameters for the first SID frame.

2. The method of claim 1, wherein storing the CN parameter sets comprises updating the buffer with a new CN parameter set for newly occurring SID frames or active hangover frames;

wherein determining the relevant subset of the CN parameter sets stored in the buffer comprises updating, for active non-hangover frames, a size K of an age restricted subset of the CN parameter sets stored in the buffer, based on a number $p_A$ of consecutive active non-hangover frames of the encoded audio signal and selecting the relevant subset from the age restricted subset, based on the residual energy values included in the CN parameter sets contained in the age restricted subset; and wherein using the representative CN parameters to determine the CN control parameters for the first SID frame comprises interpolating the representative CN parameters with decoded CN parameters of the first SID frame.

3. The method of claim 2, wherein updating the size K comprises updating, for the active non-hangover frames, the size K of the age restricted subset in accordance with:

$$K=K_0-\eta \text{ for } \eta\cdot\gamma\leq p_A<(\eta+1)\cdot\gamma$$

where $K_0$ is the number of CN parameter sets stored in the buffer, and the size K is the number of stored CN parameter sets included in the age restricted subset, $\gamma$ is a predetermined constant, and $\eta$ is a non-negative integer.

4. The method of claim 2, wherein selecting the relevant subset from the age restricted subset comprises selecting only the CN parameter subsets in the age restricted subset for which:

$$E_{k_0}^{K}-\gamma_1<E_k^{K}E_{k_0}^{K}+\gamma_2 \text{ for } k=k_0, \ldots, k_{K-1}$$

where $E_{k_0}^{K}$ is the latest residual energy value stored in the buffer, $\gamma_1$ and $\gamma_2$ are predetermined lower and upper bounds, respectively, for the residual energy values considered to be representative of noise at a transition from active to inactive frames of the encoded audio signal, and $k_0, \ldots, k_{K-1}$ are sorted such that $k_0$ corresponds to the latest and $k_{K-1}$ to the oldest stored CN parameter set.

5. The method of claim 2, wherein each stored CN parameter set comprises a vector of Auto Regressive coefficients and the residual energy value for a corresponding one of the SID or active hangover frames represented in the buffer, $Q^S$ represents the set of AR vectors for the CN parameter sets contained in the relevant subset, and $E^S$ represents the set of residual energy values for the CN parameter sets contained in the relevant subset; and wherein determining the representative CN parameters comprises determining the representative CN parameters as $\tilde{q}$ and $\bar{E}$, where $\tilde{q}$ is determined as a median vector of the set $Q^S$, $\bar{E}$ is determined as a weighted mean residual energy of $E^S$.

6. The method of claim 5, wherein the median vector $\tilde{q}$ represents the AR coefficients as Line Spectral Pairs.

7. A non-transitory computer readable medium storing a computer program for generating Comfort Noise (CN) control parameters, said computer program comprising computer readable code units that when executed by a processing circuit of a computer configures the processing circuit to:

store CN parameter sets in a buffer of a predetermined size (M) for Silence Insertion Descriptor (SID) frames and active hangover frames of an encoded audio signal, wherein the CN parameter set stored for each SID frame or active hangover frame includes a residual energy value;

determine representative CN parameters for a first SID frame following an active non-hangover frame of the encoded audio signal, based on a relevant subset of the CN parameter sets stored in the buffer, and determining the relevant subset based on an age of the stored CN parameter sets and the residual energy values;

use the representative CN parameters to determine the CN control parameters for the first SID frame.

8. A comfort noise controller for generating Comfort Noise (CN) control parameters, comprising:

a buffer of a predetermined size (M) configured to store CN parameter sets for Silence Insertion Descriptor (SID) frames and active hangover frames of an encoded audio signal, where the CN parameter set stored for each SID frame or active hangover frame includes a residual energy value; and processing circuitry configured to:

determine representative CN parameters for a first SID frame following an active non-hangover frame of the encoded audio signal, based on a relevant subset of the CN parameter sets stored in the buffer, and determine the relevant subset based on an age of the stored CN parameter subsets and the residual energy values; and use the representative CN parameters determine the CN control parameters for the first SID frame.

9. The controller of claim 8, wherein the processing circuitry comprises:

a SID and hangover frame buffer updater circuit configured to update the buffer with a new CN parameter set for each newly occurring SID frame or active hangover frame;

a non-hangover frame buffer updater circuit configured to update, for active non-hangover frames, a size K of an age restricted subset of the CN parameter sets stored in the buffer, based on a number $p_A$ of consecutive active non-hangover frames of the encoded audio signal;

a buffer element selector circuit configured to select the relevant subset from the age restricted subset, based on the residual energy values included in the CN parameter sets contained in the age restricted subset;

a comfort noise parameter estimator circuit configured to determine the representative CN parameters from the relevant subset; and a comfort noise parameter interpolator circuit configured to determine the CN control parameters for the first SID frame by interpolating the representative CN parameters with decoded CN parameters of the first SID frame.

10. The controller of claim 9, wherein the buffer element selector circuit is configured to update, for the active non-hangover frames, the size K of the age restricted subset in accordance with:

$$K=K_0-\eta \text{ for } \eta\cdot\gamma\leq p_A<(\eta+1)\cdot\gamma$$

where $K_0$ is the number of CN parameter sets stored in the buffer, and the size K is the number of stored CN parameter sets included in the age restricted subset, $\gamma$ is a predetermined constant, and $\eta$ is a non-negative integer.

11. The controller of claim 9, wherein the buffer element selector circuit is configured to select the relevant subset from the age restricted subset by selecting only the CN parameter subsets in the age restricted subset for which:

$$E_{k_0}^{K}-\gamma_1<E_k^{K}<E_{k_0}^{K}+\gamma_2 \text{ for } k=k_0, \ldots, k_{K-1}$$

where $E_{k_0}^{K}$ is the latest residual energy value stored in the buffer, $\gamma_1$ and $\gamma_2$ are predetermined lower and upper bounds, respectively, for the residual energy values considered to be representative of noise at a transition from active to inactive frames of the encoded audio signal, and $k_0, \ldots, k_{K-1}$ are sorted such that $k_0$ corresponds to the latest and $k_{K-1}$ to the oldest stored CN parameter set.

12. The controller of claim 9, wherein each stored CN parameter set comprises a vector of Auto Regressive coefficients and the residual energy value for a corresponding one of the SID or active hangover frames represented in the buffer, $Q^S$ represents the set of AR vectors for the CN parameter sets contained in the relevant subset, and $E^S$ represents the set of residual energy values for the CN parameter sets contained in the relevant subset; and wherein the comfort noise parameter estimator circuit is configured to determine the representative CN parameters as $\tilde{q}$ and $\bar{E}$, where $\tilde{q}$ is determined as a median vector of the set $Q^S$, and $\bar{E}$ is determined as a weighted mean residual energy of $E^S$.

13. The controller of claim 8, wherein the controller comprises part of an audio decoder.

14. The controller of claim 8, wherein the controller comprises part of a network node.

15. The controller of claim 8, wherein the controller comprises part of a mobile terminal.

16. An audio decoder comprising:

a buffer circuit; and processing circuitry configured to:

store, as a buffer entry in the buffer circuit, comfort-noise parameter values received for Silence Insertion Descriptor (SID) frames and active hangover frame of an encoded audio signal, the comfort-noise parameters including at least a residual energy value for the corresponding SID or active hangover frame;

for a first SID frame following one or more active non-hangover frames of the encoded audio signal:

select one or more first buffer entries, in order of recency and in dependence on how many active non-hangover frames preceded the first SID frame;

select one or more second buffer entries from the one or more first buffer entries, as those first buffer entries having residual energy values that fall within a defined range of the residual energy value of the most recent buffer entry; and generate comfort noise values for the first SID frame, in dependence on the one or more second buffer entries.

* * * * *